United States Patent [19]

Penner

[11] Patent Number: 4,635,799

[45] Date of Patent: Jan. 13, 1987

[54] DISHWARE PROTECTOR

[76] Inventor: Maureen Penner, 3994 Kitchener St., Burnaby, British Columbia, Canada, V5C 2M3

[21] Appl. No.: 606,914

[22] Filed: May 4, 1984

[51] Int. Cl.[4] ..... A47G 19/08

[52] U.S. Cl. ..... 211/41; 211/169; 134/201

[58] Field of Search ..... 211/41, 184, 59.4, 169; 220/22.1; D32/55; 206/426; 16/387, 380, 381, 382; 134/201

[56] References Cited

U.S. PATENT DOCUMENTS

| | | | |
|---|---|---|---|
| 571,017 | 11/1896 | Reeve | 134/201 X |
| 1,112,888 | 10/1914 | Burchess | 16/387 |
| 3,152,356 | 10/1964 | Parsons | 16/380 X |
| 3,289,854 | 12/1966 | Kauffman | 211/41 |
| 3,451,556 | 6/1969 | Macolcz | 211/41 |
| 3,451,557 | 6/1969 | Stoddard | 211/41 |
| 3,672,514 | 6/1972 | Tucker | 206/426 X |
| 3,960,290 | 6/1976 | Yake et al. | 220/22.1 X |
| 4,414,704 | 11/1983 | Reuter | 16/387 X |
| 4,424,607 | 1/1984 | Langenhorst | 16/387 |

FOREIGN PATENT DOCUMENTS

| | | | |
|---|---|---|---|
| 3022484 | 1/1982 | Fed. Rep. of Germany | 211/41 |
| 407394 | 3/1934 | United Kingdom | 134/201 |

*Primary Examiner*—Robert W. Gibson, Jr.
*Assistant Examiner*—Blair M. Johnson
*Attorney, Agent, or Firm*—Hughes & Cassidy

[57] ABSTRACT

A dishware protector configured for disposition within a rack of an automatic dishwasher intermediate dishware stages defined by an array of upstanding post members for isolation of individual pieces of dishware during a washing cycle to guard same against collision, is comprised of a polymeric separating member having longitudinal and lateral dimensions at least sufficient to prevent collision between adjacent dishware members in the dishwasher and a fixture element along at least one of the longitudinal edges of the separating member for securing the protector to a preselected one of the post members.

11 Claims, 5 Drawing Figures

DISHWARE PROTECTOR

BACKGROUND OF THE INVENTION

1. Field of the Invention

The present invention relates, generally, to devices for protecting dishware within an automatic dishwasher by shielding adjacent pieces of dishware from impingement or other direct contact between one another, and more especially to a dishware protector which is adapted to be interposed between adjacent dishware articles with that thought in mind.

2. Description of the Background Art

Automatic dishwashers are now commonplace in most homes. This class of apparatus has been refined greatly over the years to allow one to clean dishware in a speedy yet efficient manner. In a move toward greater convenience, many automatic dishwasher manufacturers have improved upon the design of their apparatus to a point where bakeware or other cookware may be cleaned within the dishwasher without the need to undertake an inconvenient prewashing effort. Such objectives have been achieved, in part, by increasing the force of the water streams and repositioning the source thereof throughout the cleaning cavity of the apparatus in order that the spray of cleaning water is more forceful to dislodge encrusted food particles. The move toward more powerful dishwashing cycles has not been one altogether without the creation of other problems for the user. A principal problem that has arisen is in the cleaning of fine dishware such as china or crystal, and the cleaning of other lighter weight articles which become subject to violent collisions within the dishwasher due to the greater force of cleaning water. Ordinary glassware may be broken by collision, creating great inconvenience to the user at the very least. When fine china or crystal is subjected to that type of treatment one is no longer faced simply with inconvenience, oftentimes irreplaceable dishware of greater personal value may be ruined. To a certain extent dishwasher manufacturers have responded to that problem source by including a more gentle cleaning cycle which can be employed, for example, when fine china or crystal is to be cleaned. That approach may conveniently take advantage of a reduction in the force of water pressure utilized for the cleaning cycle. However, once the design concerning the placement of waterjets is selected that obviously cannot be altered. Under many circumstances even the reduction in the force of cleaning water is not sufficient to preclude movement of fine china or crystal within the dishwasher and inadvertent collisions which can contribute to chipping and cracking if not complete shattering or breakage. Thus, while tendencies have been reduced, the problem has not been eliminated.

Various devices have been devised for placement within a dishwasher in part to overcome or ameliorate the problems aforesaid. In the main, these include rigid members disposed within the rack of a dishwasher to restrain firmly lightweight articles or articles which have a tipping tendency such as dishes or the like which are able to rock within each individual stage of the rack. Among the patented devices for such purposes may be mentioned those disclosed in U.S. Pat. Nos. 3,901,728; 3,752,322; 3,451,557; 3,451,556 and 3,289,854. The '728 patent discloses a flat or arcuate disc-like member having a central aperture allowing it to fit over the central hub of a rack within a dishwasher designed for receiving cups or the like. The disc is disposed over and in contact with the dishware to hold it, under the force of gravity alone, from dislocation or damage due to the impingement of the cleaning water sprays. Sufficient rigidity and thermal resistivity is imparted to the disc in order that the same retains stiffness and shape during a cleaning cycle. The '322 patent discloses a rack system for dishware, and principally glassware, comprised of a series of parallel rows of spaced pins, some of which are rotatably supported for movement between an upright dish-supporting position and a collapsed position adjacent the bottom of the rack. The pins may be inclined about a pivotal axis in order to be positioned in such a way as to press against lightweight articles and hold the same in a fixed relation with the rack during a cleaning cycle. The '557 and '556 patents disclose devices which are removably secured to the base of a dishwasher rack to support so-called "tipping articles" during a cleaning cycle. A common thread between the two approaches involves the use of a reticulated base in the dishwasher rack which receives specifically configured support members designed to secure or otherwise receive a particular type of dishware during a cleaning cycle. The '854 patent concerns a clip-like member in the nature of a retaining device for a plate or glassware article.

As will now be appreciated from the brief description of the prior art as aforesaid, each device heretofore proposed with an eye toward or having a coincidental function of protecting dishware from collisions during a dishwashing cycle is rather narrowly adapted to specific dishware configurations. The general thrust of the prior art has been to design a specific article to be disposed within a dishwasher to restrain a particular type of dishware during a cleaning cycle. None of the prior art approaches is very versatile. Furthermore, the prior art devices are relatively complex in geometric shape when considered from a manufacturing point of view. Thus, cost of manufacture is higher than need be while packaging costs, transportation costs and display costs are likewise higher because of the configurations suggested by those who have applied themselves in the past to these problems. Accordingly, the need exists to provide a dishware protector which accomplishes the objectives of the prior art but in a much simpler, more straightforward way thus giving rise to improved economy in manufacture, packaging, shipment and display without sacrificing operational efficiency.

SUMMARY OF THE INVENTION

The present invention responds to the needs in the art as immediately aforesaid. The present invention advantageously provides a dishware protector which not only efficiently shields adjacent pieces of dishware during a dishwashing cycle but one which is widely adaptable in use to virtually any type of dishware without loss of effectiveness regardless of size or shape of the items to be protected. The dishware protector of the present invention is desirable from the points of view of the manufacturer in terms of an elegant simplicity of design and, hence, reduced cost of manufacture. Packaging and display costs associated with the dishware protector of the present invention are substantially less than those associated with the more convoluted designs of the prior art. From the user's point of view the dishware protector of the present invention is very simple to use and yet very convenient to store when not in use.

The foregoing, and other advantages of the present invention are realized in one aspect thereof by a dishware protector configured for dispostion within a rack of an automatic dishwasher intermediate dishware stages defined by an array of upstanding post members for isolation of individual pieces of dishware during a washing cycle to guard same against collision, comprising a polymeric separating member having longitudinal and lateral dimensions at least large enough to prevent collisions between adjacent dishware members in the dishwasher during the washing cycle and fixture means along at least one longitudinal edge or lying along a longitudinal dimension of the separating member for securing same to a preselected one of the post members within the rack. The separating member may be a solid separating member or a perforate one allowing cleaning water to pass through the protector should that be a necessary or desirable consideration respecting the design or recommendations of a particular dishwasher manufacturer. The separating member member will usually be rectilinear and sized to extend between adjacent post members and present an upstanding shielding element between dishes, glasses, or the like. Height is a variable with respect to the size or shape of the adjacent dishware to be protected, as is width but to a lesser extent. Alternatively, circular (or indeed irregularly shaped) separating member may optionally be employed should that be deemed advantageous in certain situations. Regardless of such considerations, the fixture means for retaining the separating member in place are preferably integral or unitary components of the device. Most preferably, the fixture means are comprised of a longitudinal slot or channel disposed along a longitudinal or marginal edge of the protector in order to receive an upstanding post member and thereby restrain the separating member thereon. The channel may be circular inasmuch as the vast majority of posts are generally circular and typically upright. Optionally, in order to accommodate a post having an angled or twisted geometry, the channel could be ovate in cross section at the desire of the designer to provide some flexibility in disposing the separating member about or over such a pin. As a further option, and particularly where a non-rectilinear separating member is utilized, the channel may be formed along a surface at any convenient position thereon.

Other advantages of the present invention, and a fuller appreciation of its mode of construction and operation, will be gained upon an examination of the following detailed description of preferred embodiments, taken in conjunction with the figures of drawing, wherein:

DESCRIPTION OF THE INVENTION

The present invention relates, generally, to devices for protecting dishware within an automatic dishwasher by shielding adjacent pieces of dishware from impingement or other direct contact between one another, and more especially to a dishware protector which is adapted to be interposed between adjacent dishware articles with that thought in mind. Accordingly, the present invention will now be described with reference to certain preferred embodiments within the aforementioned context; albeit, those skilled in the art will appreciate that such a description is meant to be exemplary and should not be deemed limitative.

Figure 5:
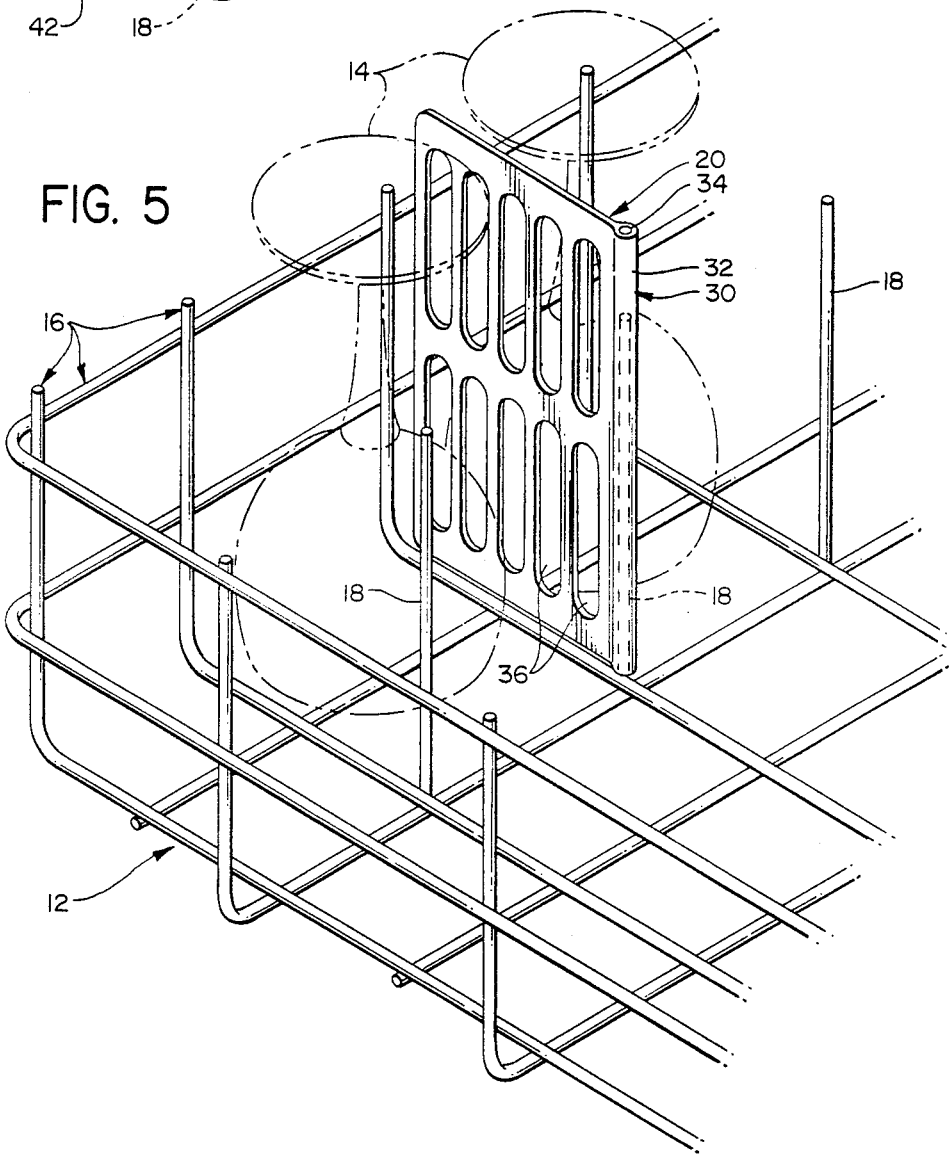

Referring to the figures of drawing, in each of which like parts are identified with like reference characters, an automatic dishwasher identified generally as 10 is shown to be comprised of, inter alia, a dishware rack 12 for receiving items of dishware such as the stemmed glasses 14 shown in phantom lines. A conventional dishware rack, as best viewed in FIG. 5, is typically comprised of a plurality of wire-like elements designated generally as 16, which define an outer periphery providing the overall shape of the rack receiving the dishware. An array of upstanding post members 18 is located within the interior confines of the open grid work of rack 12 in order, in turn, to define a plurality of dishware stations or stages arranged in a serial fashion along the length and breadth of the rack 12. Thus, as shown best in FIG. 5, two dishware stations are defined between the outer peripheral members 16 and the inner upstanding post members 18 receiving the two glassware members 14 (shown in phantom) to be washed within the automatic dishwasher 10. All other things being equal, water flow directed from a position beneath the rack 12 will tend to raise or otherwise move the dishware about within the dishware stations of the rack inasmuch as the same only provide general contours for receiving a wide variety of dishware having differing shapes and sizes. The force of water will cause rocking or other similar movement which can and often will contribute to sufficient motion that these adjacent pieces of dishware will collide. Such collisions can and often do lead to broken dishware. A dishware protector identified generally as 20 is shown disposed intermediate these adjacent pieces of dishware in order to guard against that particular occurrence.

The dishware protector 20 is illustrated in the figures of drawing to be comprised of a separating member 22, most preferably a polymeric separating member fabricated from a material which is "dishwasher safe." Many different chemical compositions will suffice to provide a separating member which has a relatively low degree of drape but without being too stiff or rigid to be associated easily with the rack 12, as considered further below, while presenting a good cushioning member. In the illustrated form, the separating member 22 is a rectilinear web having opposed longitudinal edges 24 and transverse edges 26. Fixture means identified generally as 30 are formed along one of the longitudinal or marginal edges 24 in order to secure the separating member 22 within the rack 12. In the form shown, for example in FIG. 2, that fixture means is comprised of a longitudinal slot or channel 32 having a bore or longitudinal aperture 34 configured and dimensioned suitably to permit the dishware protector to be secured on an upstanding post 18 with the same received interiorly of the channel as best viewed in FIG. 5. In one preferred form of the invention, the separating member 22 includes a series of perforations or slots 36 as shown, for example, in FIG. 2. These perforations permit cleaning water to channel through the dishware protector 20 during a washing cycle. Depending upon the manufacturer's placement of the water sprays (including moveable spray arms and the like), it may be important or desirable to permit a free flow of water through the protector as will thus be facilitated by these perforations.

Figure 3:
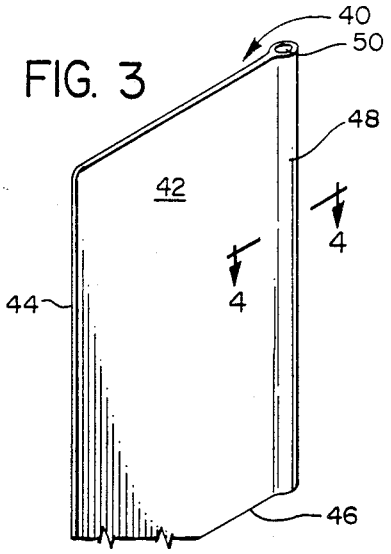
FIG. 3 is a view similar to FIG. 2, showing an alternate embodiment of a preferred dishware protector in accordance with the present invention.

An alternate embodiment of a dishware protector in accordance with the present invention, designated generally as 40, is illustrated in FIG. 3. This embodiment is generally similar to that of FIG. 2, including a separating member 42 having longitudinal edges 44 and transverse edges 46. A channel 48 is formed along one of the longitudinal edges, once again including a central bore or aperture, here identified as 50. In this instance, the aperture 50 is an ovate aperture having a minor axis approximately equal to the diameter of a pin 18 but a major axis somewhat greater than that dimension. There are several advantages to this type of ovate cross section for the slot which can make it more desirable than a circular one. Principally, in certain dishwasher designs the pin members 18 may include a bend at or near the upper end thereof or a similar "kink" along the length thereof. The ovate geometry of channel 50 allows the protector to be inserted over such a pin with somewhat greater ease than were the channel a generally circular one. The protector 40 differs from the protector 20 in the further aspect of its solid panel or separating member 42, lacking the perforations 36 present in the latter. Otherwise, the dishware protector 40 functions in substantially the same way as that idenfied as 20.

Figure 2:
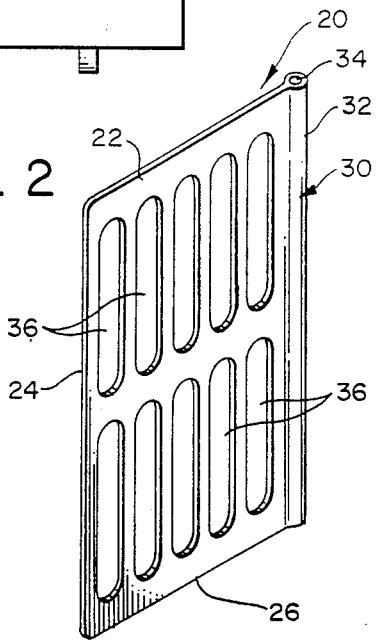
FIG. 2 is an isometric view of the dishware protector shown in FIG. 1.
Figure 4:
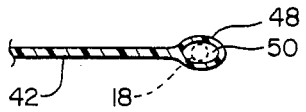
FIG. 4 is a sectional view, taken substantially along the line 4—4 of FIG. 3; and, FIG. 5 is an isometric view of the rack shown in FIG. 1, illustrating with greater clarity the manner in which a dishware protector of the present invention, such as the one illustrated in FIG. 2, is disposed within that rack member.

The dishware protector of the present invention, regardless of the differences between embodiments shown in FIGS. 2 and 3, is very easily disposed within the rack 12 of dishwasher 10. As best viewed in FIG. 5, this preferred embodiment includes a dishware protector having a generally rectilinear overall configuration with a marginal channel for disposition over an upstanding pin. The longitudinal dimension of the protector is selected to provide a barrier or shield between and cushioning the two adjacent dishware members 14 and a lateral dimension sufficient to span the respective dishware stations defined by the pins 18. In this exemplary embodiment the longitudinal edge opposed from that having the fixture means is free to move thus facilitating the loading of the rack; the dishware protector being received in generally pivotal engagement about the pin member 18 as best envisioned with reference to the figure. Under certain circumstances it may be desirable to include a fixture means along both longitudinal edges; albeit, should the same geometry of a slot or channel be utilized, obviously only interior dishware stations or stages might be bridged as opposed to those lying in the peripheral region of the rack.

Figure 1:
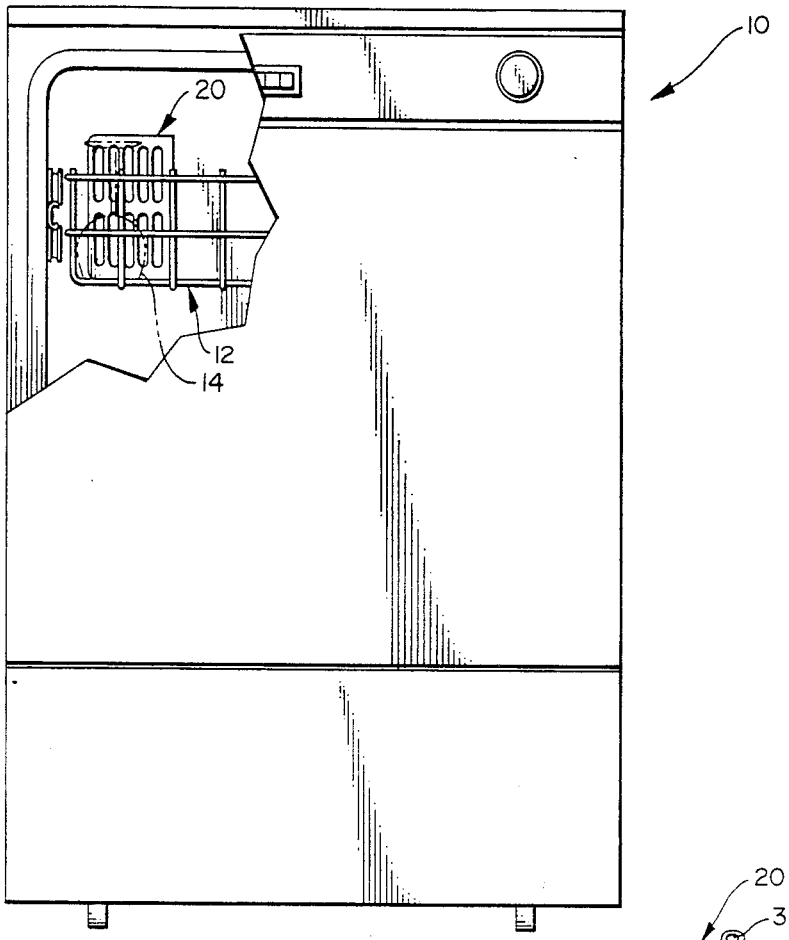
FIG. 1 is a front elevation view of a typical automatic dishwasher, with parts broken away to show an upper rack having glassware disposed therein, as shown in phantom lines, separated by a preferred form of dishware protector in accordance with the present invention.

The overall shape or configuration of the dishware protectors of the present invention may vary from that illustrated in the preferred embodiments of the figures of drawing. For example, the lateral dimension may be wide enough to span more than one dishware station as shown, for example, in FIGS. 1 and 5. In such a case, the separating member 22 may simply be a mirror image on the opposed side of the fixture member or channel 30. In such a way the device can span several dishware stations should that be desirable. By including but a single central fixture slot or channel the opposed web members may be moved very easily in order to maintain the advantage of ease of loading while the dishware protectors are secured within the bracket members. It is also envisioned within the general scope of the present invention to employ dishware protectors which have other than the rectilinear overall geometry illustrated in the figures of drawing. Elliptical, circular, or even irregular overall geometries may be found desirable depending upon the shape or configuration of the dishware to be protected. In such a case, the channel for dispostion about a pin member may be formed along a surface of the protector for securing it within the rack. For example, considering a circular separating member as exemplary, a channel along a radius across a surface face would permit the separating member to be affixed to the rack 12 and operate otherwise in the same manner as described above. Such a non-rectilinear geometry might optionally include the same perforate surface as shown, for example, in FIG. 2 in order to permit the passage of water through the protector should that be desirable as a mode of operation.

Still other variations on the overall configuration of the dishware protector of the present invention may be made without loss of its overall functionality. Thus, while the invention has now been described with reference to certain preferred embodiments, various modifications, changes, omissions and substitutions might be made without departing from the spirit thereof. Accordingly, it is intended that the scope of the present invention not be limited by the present description but be interpreted consistent with the scope of the claims granted herein.

What is claimed is:

1. A dishware holding and protecting assembly, comprising:

(a) a rack of an automatic dishwasher, having intermediate dishware stages defined by an array of upstanding post members to receive individual pieces of dishware during a washing cycle;

(b) a dishware protector disposed within said rack and comprisng a polymeric separating member having longitudinal and lateral dimensions at least sufficient to yield means for preventing collision between adjacent dishware members in said dishwasher and fixture means for pivotally securing said protector to a preselected one of said post members, said fixture means being disposed along said longitudinal dimension.

2. The dishware protector of claim 1, wherein said separating member is a perforate web.

3. The dishware protector of claim 1, wherein said separating member is a solid separating member.

4. The dishware protector of claim 1, wherein said separating member is a rectilinear separating member.

5. A dishware holding and protecting assembly, comprising:

(a) a rack of an automatic dishwasher, having intermediate dishware stages defined by an array of upstanding post members to receive individual pieces of dishware during a washing cycle;

(b) a dishware protector disposed within said rack and comprising a polymeric separating member having longitudinal and lateral dimensions at least sufficient to yield means for preventing collision between adjacent dishware members in said dishwasher and fixture means for pivotally securing said protector to a preselected one of said post members, said separating member being a rectilinear separating member.

6. A dishware holding and protecting assembly, comprising:

(a) a rack of an automatic dishwasher, having intermediate dishware stages defined by an array of upstanding post members to receive individual pieces of dishware during a washing cycle;

(b) a dishware protector disposed within said rack and comprising a polymeric separating member having longitudinal and lateral dimensions at least sufficient to yield means for preventing collision between adjacent dishware members in said dishwasher and fixture means for securing said protector to a preselected one of said post members, said fixture means securing said protector to said post member in pivotal engagement therewith, said separating member being a solid separating member.

7. A dishware holding and protecting assembly, comprising:

(a) a rack of an automatic dishwasher, having intermediate dishware stages defined by an array of upstanding post members to receive individual pieces of dishware during a washing cycle;

(b) a dishware protector disposed within said rack and comprising a polymeric separating member having longitudinal and lateral dimensions at least sufficient to yield means for preventing collision between adjacent dishware members in said dishwasher and fixture means for securing said protector to a preselected one of said post members, said fixture means securing said protector to said post member in pivotal engagement therewith, said separating member being a rectilinear separating member.

8. A dishware holding and protecting assembly, comprising:

(a) a rack of an automatic dishwasher, having intermediate dishware stages defined by an array of upstanding post members to receive individual pieces of dishware during a washing cycle;

(b) a dishware protector disposed within said rack and comprising a polymeric separating member having longitudinal and lateral dimensions at least sufficient to yield means for preventing collision between adjacent dishware members in said dishwasher and fixture means for securing said protector to a preselected one of said post members, said fisture means being comprised of a generally longitudinal slot disposed along said longitudinal dimension.

9. The dishware protector of claim 8, wherein said longitudinal slot has an ovate cross-section for receiving said post member.

10. A dishware holding and protecting assembly, comprising:

(a) a rack of an automatic dishwasher, having intermediate dishware stages defined by an array of upstanding post members to receive individual pieces of dishware during a washing cycle;

(b) a dishware protector disposed within said rack and comprising a generally rectilinear polymeric web having longitudinal and lateral dimensions at least sufficient to yield shield means for preventing collision between adjacent dishware members in said dishwasher, and a longitudinal slot disposed along a marginal edge of said rectilinear web having a central aperture therethrough for securing said protector to a preselected one of said post members.

11. The dishware protector of claim 10, wherein said longitudinal slot has an ovate cross section.

* * * * *